US007787807B2

(12) United States Patent
Nakaue et al.

(10) Patent No.: US 7,787,807 B2
(45) Date of Patent: Aug. 31, 2010

(54) DEVELOPING UNIT AND IMAGE FORMING APPARATUS INCLUDING THE SAME

(75) Inventors: Takahisa Nakaue, Osaka (JP); Shoichi Sakata, Osaka (JP)

(73) Assignee: Kyocera Mita Corporation (JP)

( * ) Notice: Subject to any disclaimer, the term of this patent is extended or adjusted under 35 U.S.C. 154(b) by 472 days.

(21) Appl. No.: 11/820,777

(22) Filed: Jun. 20, 2007

(65) Prior Publication Data

US 2008/0124137 A1 May 29, 2008

(30) Foreign Application Priority Data

Jun. 21, 2006 (JP) ..... 2006-171780

(51) Int. Cl.
*G03G 15/09* (2006.01)

(52) U.S. Cl. ..... 399/277; 399/272; 399/276

(58) Field of Classification Search ..... 399/272, 399/275, 276, 277
See application file for complete search history.

(56) References Cited

U.S. PATENT DOCUMENTS 4,068,623 A * 1/1978 O'Toole et al. ..... 399/272
6,959,163 B2 * 10/2005 Nishiyama ..... 399/269

FOREIGN PATENT DOCUMENTS

JP 6-130819 5/1994

* cited by examiner

*Primary Examiner*—David P Porta
*Assistant Examiner*—Benjamin Schmitt
(74) *Attorney, Agent, or Firm*—Gerald E. Hespos; Michael J. Porco

(57) ABSTRACT

A developing unit includes a development roller and a magnetic roller. Sleeves of the development roller and the magnetic roller are driven to rotate in the same circumferential direction. A first magnet is provided on the roller shaft in the sleeve of the development roller and a second magnet is provided on the roller shaft in the sleeve of the magnetic roller. The first and second magnets are opposed to each other so that opposite polarities face each other, and are supported non-rotatably in circumferential directions. The first magnet is supported so that the peak of the magnetic force of the first magnet is positioned upstream in the direction of rotation of the sleeve of the development roller from the straight line connecting the center of the roller shaft of the development roller to the center of the roller shaft of the magnetic roller.

9 Claims, 8 Drawing Sheets

DEVELOPING UNIT AND IMAGE FORMING APPARATUS INCLUDING THE SAME

BACKGROUND OF THE INVENTION

1. Field of the Invention

The present invention relates to a developing unit used in an image forming apparatus such as a copying machine, printer, and facsimile machine, and to an image forming apparatus including the developing unit.

2. Description of the Related Art

Image forming apparatuses based on electrophotography are available generally that use a two-component developer consisting primarily of carriers and toner to develop an image. In this method, the developing unit includes a magnetic roller containing a magnet member. The magnetic roller holds the developer and forms a magnetic brush with carriers. The magnetic brush is brought into contact with an image carrier to supply toner to the image carrier.

There is another system for developing an image using a two-component developer in which two rollers, a magnetic roller and a development roller, are provided in a developing unit. In this system, the magnetic roller containing a magnet member first holds the two-component developer and a magnetic brush with carriers is formed on the magnetic roller. The magnetic brush is brought into contact with the development roller to form a thin layer consisting only of toner on the development roller. Then the toner jumps from the development roller to the image carrier, where an electrostatic latent image is developed. This system has an advantage that the image quality can be improved while maintaining stability and high speed, which are typical of the two-component development, because the magnetic brush of the magnetic roller is not directly in contact with the image carrier (see Japanese Patent Laid-Open No. 06-130819 for example).

In such a developing unit, the development roller and the magnetic roller are disposed in such a manner that they face each other with a gap between them. The magnetic brush is formed in the gap. The magnetic brush formed between the magnetic roller and the development roller has a significant impact on the quality of an image formed.

In particular, after an electrostatic latent image is developed, toner jumps from the development roller to the image carrier and regions (portions) where toner is removed and regions (portions) where toner is left without being consumed are formed on the development roller. If formation of the toner thin layer is continued, non-uniformity in the thickness of the toner thin layer on the development roller increases. As a result, the density of toner on a formed image becomes uneven and images formed earlier may appear (development history).

To prevent this phenomenon, toner remaining on the development roller after development of an electrostatic latent image is removed by the magnetic brush. Then, a new toner thin film is formed on the development roller. However, if the binding force of the magnetic brush is weak, toner remaining on the development roller is not completely removed, which can cause development history.

Depending on the shape of a magnetic brush formed, developer tends to accumulate in a region of the magnetic brush located upstream in the direction of rotation of the magnetic roller, that is, a portion (region) where toner is supplied to the development roller in order to form a thin layer of toner. The accumulated developer can cause the problem that carriers are conveyed to the development roller together with toner. When developer further accumulates to an excessive amount, developer can spill over or out of the developing unit and make the interior of the image forming apparatus dirty. These problems can degrade an image formed.

In this way, the magnetic brush formed in the gap between the magnetic roller and the development roller significantly affects the quality of an image formed.

The developing unit disclosed in Japanese Patent Laid-Open No. 06-130819 has a development roller which is placed opposite an image carrier and holds a toner layer, and a magnetic roller which is placed opposite the development roller and has a two-component developer consisting of carriers and toner on its surface. A magnetic pole is provided inside the magnetic roller at a position where the magnetic roller faces the development roller and a magnetic force drop at the center of the magnetic pole is set in such a manner that peak value on both sides of it will not be of repelling poles.

FIG. 8 is a schematic cross-sectional view for illustrating the conventional developing unit described above. As shown in FIG. 8, the magnetic roller 65 has a magnet 65*a* and a rotating sleeve 65*b*. In the magnetic roller 65, the magnet 65*a* is magnetized so that the magnet 65*a* has five magnetic poles: a main pole N1, a trimming pole N2, a conveying pole S1, a pickup pole S2, and pickoff pole S3. Curves in FIG. 8 represent the magnitudes of magnetic forces (gausses). The main pole N1, which faces the development roller 64, has a small magnetic force drop portion GL formed at its center. Magnetic brush is formed in the peak positions P on both sides of the magnetic force drop portion GL on the surface of the magnetic roller 65, which come into relatively soft contact with the development roller 64. The magnetic force drop portion GL is filled with a larger amount of developer and comes into contact with the development roller 64 with a higher pressure. Because the magnetic force drop is small and the contact pressure is high, accumulation and movement of the developer, which would occur in typical repelling magnetic poles (the pickoff pole S3 and the pickup pole S2) , do not occur. Therefore, a good conveying state can be maintained during fast rotation of the magnetic roller 65.

However, in the conventional developing unit, since the magnetic brush (represented by black dots in FIG. 8) is formed in a radial pattern from the magnetic roller 65 toward the development roller 64, the magnetic brush tilts obstructingly in the direction in which the developer is conveyed on the magnetic roller 65 (the direction of rotation of the magnetic roller 65), thereby causing accumulation of the developer. Consequently, a problem arises that carriers are conveyed onto the development roller 64 together with toner. Another problem arising is that when the developer further accumulates, a significant amount of the developer can spill out of the developing unit to soil the interior of the image forming apparatus.

Furthermore, while the conventional developing unit can ensure a uniform thickness of the thin layer of toner formed, the developing unit does not adequately remove residual toner. Accordingly, the toner on the development roller is nonuniformly charged and therefore does not uniformly jump during development even when additional toner is added to the remaining toner to form a thin toner layer. Consequently, it is difficult to prevent development history.

SUMMARY OF THE INVENTION

An object of the present invention is to provide a developing unit capable of reliably removing toner on a development roller to minimize development history while reducing accumulation of a developer to prevent carriers from being conveyed to the development roller and to prevent the interior of an image forming apparatus from being soiled with the developer by appropriately forming a magnetic brush. Another object of the present invention is to provide an image forming apparatus capable of forming a good-quality and stable image by using the developing unit.

According to an aspect of the present invention, there is provided a developing unit including: a development roller that is opposed to an image carrier and supplies toner to the image carrier; and a magnetic roller that is opposed to the development roller and supplies toner to the development roller; wherein a sleeve of the development roller and a sleeve of the magnetic roller are driven to rotate in the same circumferential direction; a first magnet member is provided on a roller shaft in the sleeve of the development roller; a second magnet member is provided on a roller shaft in the sleeve of the magnetic roller; the first and second magnet members are opposed to each other so that opposite polarities face each other, and are supported non-rotatably in circumferential directions; and the first magnet member is supported so that the peak of magnetic force of the first magnet member is positioned upstream in the direction of rotation of the sleeve of the development roller from the straight line connecting the center of the roller shaft of the development roller to the center of the roller shaft of the magnetic roller.

Since a magnetic brush can be appropriately formed in the developing unit, toner can be reliably removed from a development roller to minimize development history while reducing accumulation of a developer to prevent carriers from being conveyed to the development roller and to prevent the interior of an image forming apparatus from being soiled with the developer.

An image forming apparatus according to another aspect of the present invention includes the developing unit described above and an image carrier supplied with toner from the developing unit.

By using the developing unit in the image forming apparatus, the quality of an image formed can be improved and stabilized.

DETAILED DESCRIPTION OF THE PREFERRED EMBODIMENTS

An embodiment of the present invention will be described with reference to FIGS. 1 to 6. The embodiment will be described with respect to an electrophotography-based tandem full-color image forming apparatus. Configurations, arrangements, and other elements given in the description of the present embodiment are not limitative but illustrative.

An overview of the image forming apparatus including a developing unit according to one embodiment of the present invention will be described first with reference to FIGS. 1 and 2.

Figure 1:
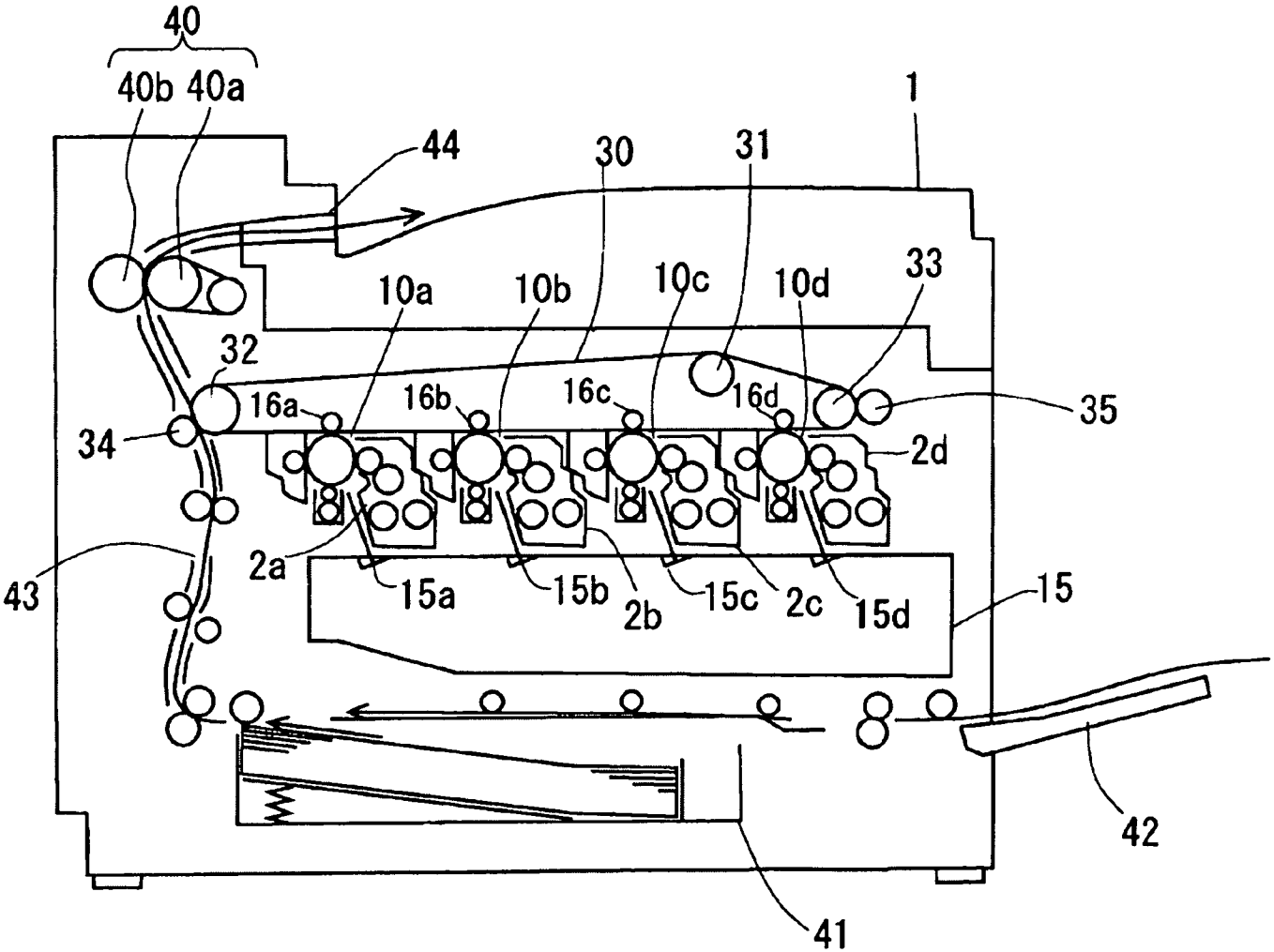
FIG. 1 is a cross-sectional view schematically showing a configuration of an image forming apparatus according to one embodiment of the present invention, viewed from the front.

FIG. 1 is a cross-sectional view schematically showing a configuration of an image forming apparatus according to one embodiment of the present invention, viewed from the front. FIG. 2 is an enlarged cross-sectional view of an image forming section of the image forming apparatus shown in FIG. 1.

Figure 2:
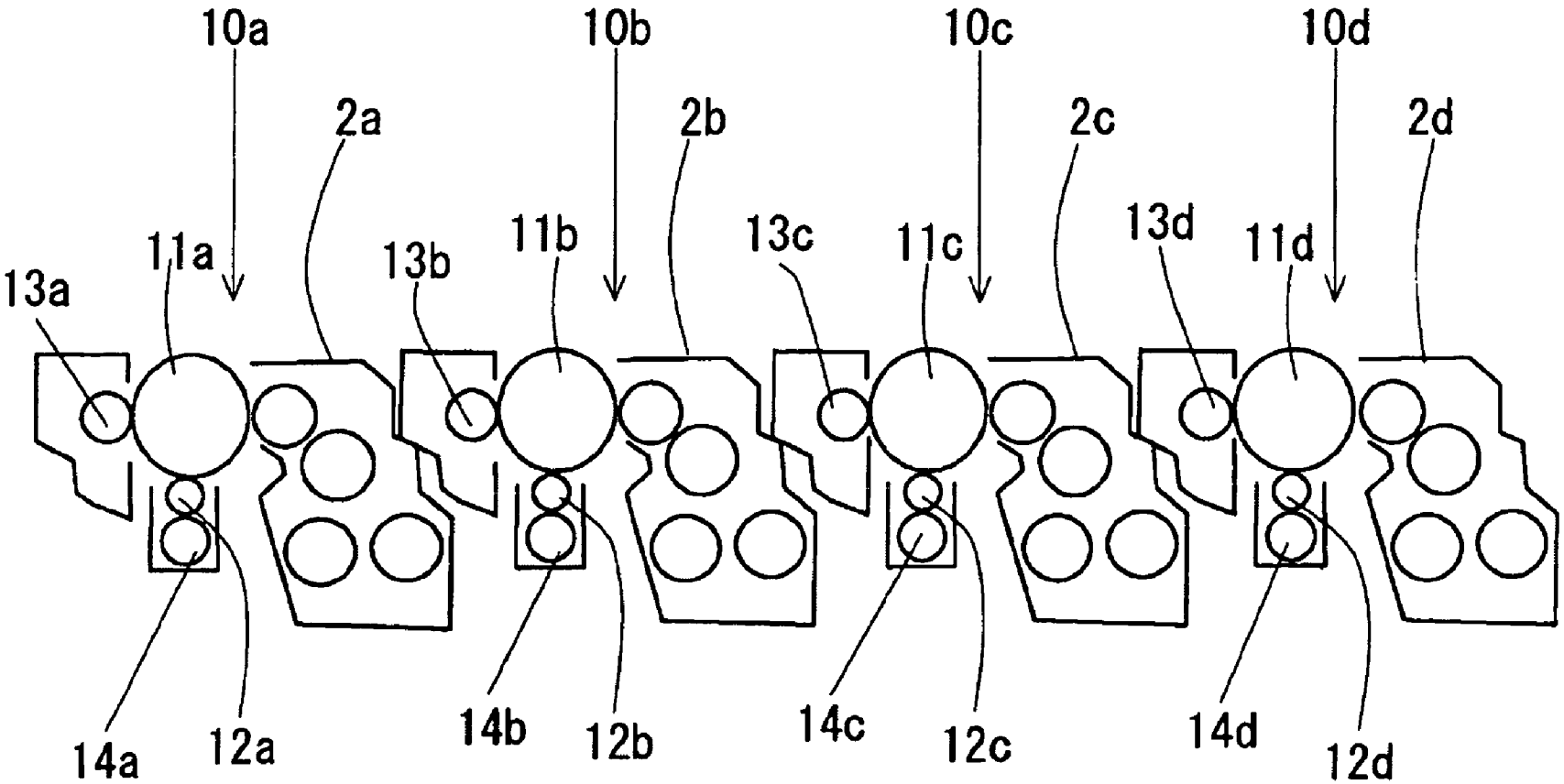
FIG. 2 is an enlarged cross-sectional view of an image forming section of the image forming apparatus shown in FIG. 1.

As shown in FIGS. 1 and 2, the image forming apparatus 1 includes an image forming section 10*a* that forms a black image, an image forming section 10*b* that forms a yellow image, an image forming section 10*c* that forms a cyan image, and an image forming section 10*d* that forms magenta image. The four image forming sections 10*a* to 10*d* are arranged in line at a spacing.

Each of the image forming sections 10*a*-10*d* includes a photosensitive drum 11*a*-11*d*, a charging roller 12*a*-12*d*, a drum cleaning roller 13*a*-13*d*, a cleaning member 14*a*-14*d*, and a developing unit 2*a*-2*d*. Details of the image forming sections 10*a*-10*d* will be described later.

In an optical unit 15, which serves as exposure means, a laser beam 15*a*-15*d* modulated in accordance with a time-series electric digital pixel signal of image information input from a host computer (not show) is output from a laser output section (not shown) and sweeps the surface of each photosensitive drum 11*a*-11*d*. This operation forms an electrostatic latent image in colors depending on the image information on the surface of the photosensitive drum 11*a*-11*d* charged by the charging roller 12*a*-12*d*.

Transfer rollers 16*a*-16*d*, which function as transfer means, abut on the photosensitive drums 11*a*-11*d*, respectively, through an intermediate transfer belt 30, which is an endless belt, at primary transfer nip sections. The intermediate transfer belt 30 is laid across a tension roller 31, a driving roller 32, and a driven roller 33 and is driven by the driving roller 32 to rotates (move) clockwise viewed from the front. The intermediate transfer belt 30 is made of dielectric resin such as a polycarbonate resin film, polyethylene terephthalate resin film, or polyvinylidene fluoride resin film.

The driving roller 32 abuts a secondary transfer roller 34 through the intermediate transfer belt 30 to form a secondary transfer section. The secondary transfer roller 34 is provided in such a manner that it can be in and out of contact with the intermediate transfer belt 30. A fuser 40 having a fuser roller 40*a* and a pressure roller 40*b* is provided downstream of the secondary transfer section in the direction in which a transfer material is conveyed.

The image forming sections 1-*a*-1-*d* will be described with reference to FIG. 2. As shown in FIG. 2, provided in each of the image forming sections 10*a*-10*d* are a photosensitive drum 11*a*-11*d*, which is an image carrier, a charging roller 12*a*-12*d* for electrically charging the photosensitive drum 11*a*-11*d*, a drum cleaning roller 13*a*-13*d*, a cleaning member 14*a*-14*d*, and a developing unit 2*a*-2*d*. The developing units 2*a*-2*d* will be described in detail later.

In each of the image forming sections 10*a*-10*d*, the photosensitive drum 11*a*-11*d* has a positively charged photosensitive layer of an OPC (organic photo conductor) or amorphous silicon on the outer circumference of the drum made of aluminum, for example, and is driven by a driving unit (not shown) to rotate in counterclockwise, viewed from the front, at a predetermined process speed.

Each of the charging rollers 12*a*-12*d*, which are charging means, uniformly charges the surface of the photosensitive drum 11*a*-11*d* by a charging bias applied from a charging bias power supply (not shown) to a predetermined electric potential. The charging roller 12*a*-12*d* is rotated clockwise, viewed from the front, at a predetermined process speed.

Each of the drum cleaning rollers 13*a*-13*d* is a cylinder made of an elastic material such as EPDM (ethylene propylene diene rubber), for example, provided on outer periphery of a rotating shaft for removing and collecting toner remaining on the surface of each photosensitive drum 11*a*-11*d*, and is rotated counterclockwise, viewed from the front, at a predetermined process speed.

Each of the cleaning members 14*a*-14*d* rotates in a predetermined direction and removes toner and foreign matter (charge products) attached to the surface of the charging roller 12*a*-12*d*. As such, the cleaning member 14*a*-14*d* is a roller made up of a rod-like supporting member and a brush of a material such as a resin wrapped around the rod-like supporting member.

An image forming operation performed by the image forming apparatus described above will be described below. When an image formation start signal is issued, the photosensitive drums 11*a*-11*d* being rotated at a predetermined process speed are uniformly positively charged by the charging rollers 12*a*-12*d*. In the optical unit 15, the laser output section transforms each of input color-separated image signals to a light signal. The laser beam 15*a*-15*d*, which is the transformed light signal, scans and exposes the charged photosensitive drum 11*a*-11*d* to form an electrostatic latent image.

Then, the developing unit 2*d* to which a development bias of the same polarity as the charge polarity (positive) of the photosensitive drum lid is applied attaches magenta toner onto an electrostatic image formed on the photosensitive drum lid and the electrostatic latent image is visualized as a toner image. The magenta toner image is primary-transferred onto the revolving (moving) intermediate transfer belt 30 by the transfer roller 16*d* to which a primary transfer bias (of the polarity (negative) opposite to that of the toner) is applied in the primary transfer section between the photosensitive drum lid and the transfer roller 16*d*.

The intermediate transfer belt 30 to which the magenta toner image has been transferred is revolved (moved) toward the image forming section 10*c*. In the image forming section 10*c*, a cyan toner image formed on the photosensitive drum 11*c* in the same way as described above overlaps with the magenta toner image on the intermediate transfer belt 30 and is transferred in the primary transfer section.

Similarly, yellow and black toner images formed on the photosensitive drums 11*b* and 11*a* in the image forming sections 10*b* and 10*a*, respectively, overlap with the magenta and cyan toner images superimposed and transferred on the intermediate transfer belt 30 in the primary transfer sections to form a full color toner image on the intermediate transfer belt 30. The toner images overlapped on the intermediate transfer belt 30 are secondarily transferred to a transfer material conveyed in the secondary transfer section. The transfer material is conveyed to a fuser 40, where the toner image is fixed to the transfer material, then the transfer material is ejected through an ejection section 44 (see FIG. 1).

Toner remaining on each photosensitive drum 11*a*-11*d* after the primary transfer is removed and collected by each drum cleaning roller 13*a*-13*d*. Toner remaining on the intermediate transfer belt 30 after the secondary transfer is removed and collected by a belt cleaning roller 35 (see FIG. 1).

When a single color image (for example a monochrome image) is to be formed, a particular image forming section (for example the image forming section 10*a*) primarily transfers a single color visible image (for example a monochrome image) onto the intermediate transfer belt 30 and then a process similar to the process for forming a full color image described above can be performed to obtain a single color image.

The arrow shown in FIG. 1 indicates the direction in which a transfer material such as paper is conveyed. A transfer material is fed from an automatic paper feeder 41 or a manual feeding tray 42 to a conveying path 43, transfer is performed in the secondary transfer section, a toner image is permanently fused to the transfer material in the fuser 40, and the transfer material is ejected through the ejection section 44 (see FIG. 1).

Figure 3:
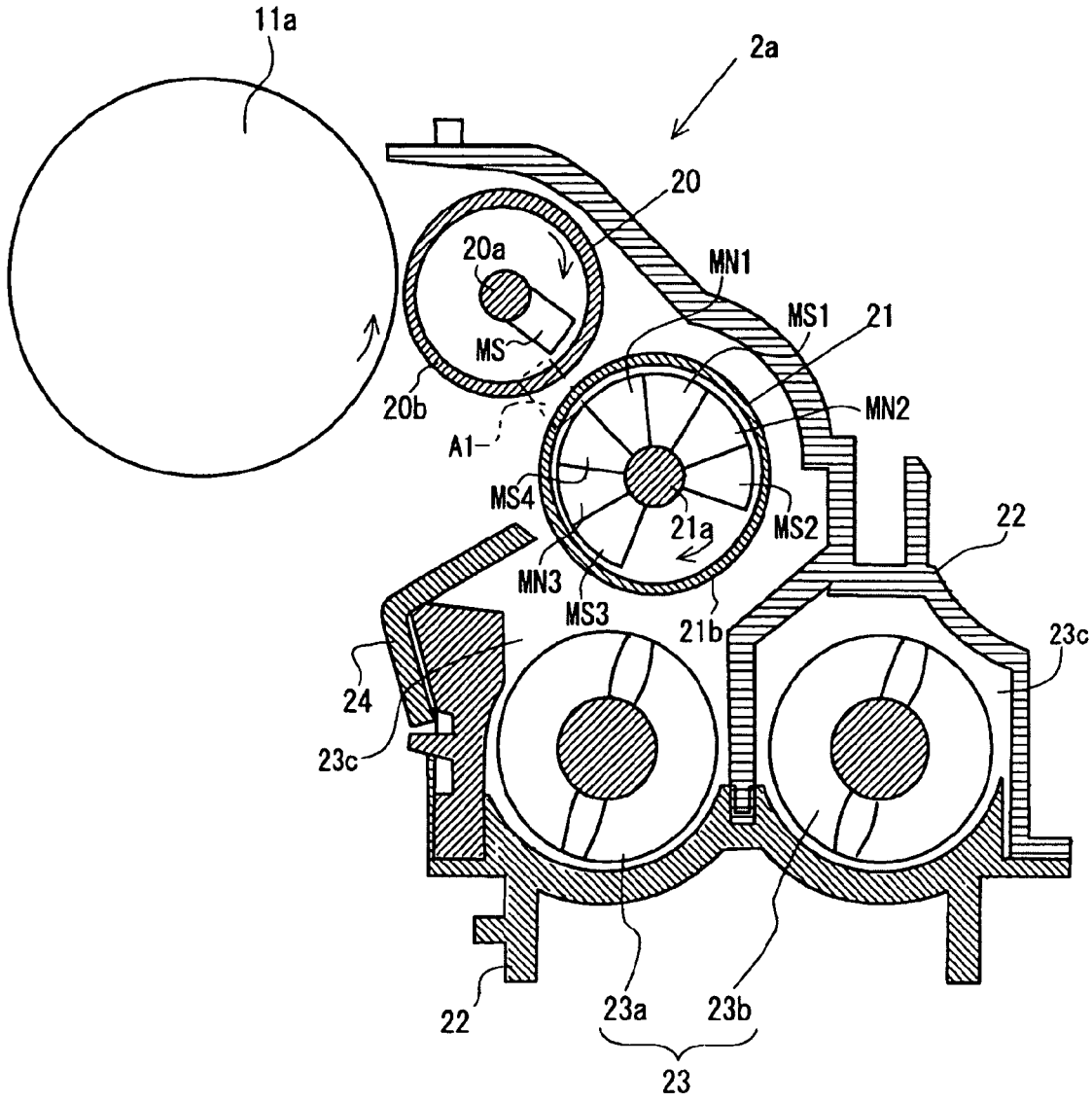
FIG. 3 is a cross-sectional view schematically showing a configuration of a developing unit shown in FIG. 2.

A configuration of each developing unit 2*a*-2*d* according to an embodiment of the present invention will be described below with respect to FIG. 3. FIG. 3 is a cross-sectional view schematically showing a configuration of the developing unit shown in FIG. 2. Since the developing units 2*a*-2*d* have the same configuration, the description will be provided mainly with respect to the developing unit 2*a* as an example. The same description applies to the developing units 2*b* to 2*d* unless otherwise stated.

The image forming apparatus 1 includes four developing units: the developing unit 2*a* which contains a developer made up of black toner and carriers to develop a black image, a developing unit 2*b* containing a developer made up of yellow toner and carriers to develop a yellow image, a developing unit 2*c* containing a developer made up of cyan toner and carriers to develop a cyan image, and a developing unit 2*d* containing a developer made up of magenta toner and carriers to develop a magenta image. The four developing units constitute part of each image forming section 10*a*-10*d* (see FIG. 1).

Each of the developing units 2*a* to 2*d* causes the color toner to attach to an electrostatic latent image formed on each photosensitive drum 11*a*-11*d* to develop (visualize) a toner image. Each of the developing units 2*a*-2*d* can use a two-component development method which uses a developer that is a mixture of toner particles and magnetic carriers.

As shown in FIG. 3, the developing unit 2*a* includes a development roller 20, a magnetic roller 21, a frame 22, conveying members 23*a*, 23*b*, and a restraining blade 24.

As shown in FIG. 3, a development roller 20 is provided that faces a photosensitive drum 11*a* spaced a predetermined distance apart. On the lower right in FIG. 3, a magnetic roller 21 is provided that faces the development roller 20 spaced a predetermined distance apart. Two conveying members 23*a* and 23*b* (hereinafter collectively referred to as the conveying members 23) are provided below the magnetic roller 21. The restraining blade 24 is provided to the left of the magnetic roller 21 in FIG. 3. The development roller 20, the magnetic roller 21, the two conveying members 23*a* and 23*b*, and the restraining blade 24 are held by the frame 22.

A developer mainly made up of magnetic carriers and toner agitated by the conveying members 23 is held on the outer periphery of the magnetic roller 21 and the magnetic roller 21 supplies toner to the development roller 20. In particular, the developer is supplied to the magnetic roller 21 above the conveying member 23*a*. The magnetic roller 21 forms a magnetic brush and provides toner to the development roller 20 to form a thin layer of toner on the development roller 20. Details of the formation will be described later.

Each of the two conveying members 23 provided in each developing unit has a screw provided on a shaft in a spiral fashion. The developer is conveyed and agitated by the conveying member 23 in such a manner that the developer circulates in a developer reservoir 23*c* and is charged to a predetermined level. With this charge, the toner particles are held by the carriers. The restraining blade 24 is provided for restraining the layer of a magnetic brush formed on the magnetic roller 21 and adjusts the magnetic brush to a predetermined height.

Figure 4A:
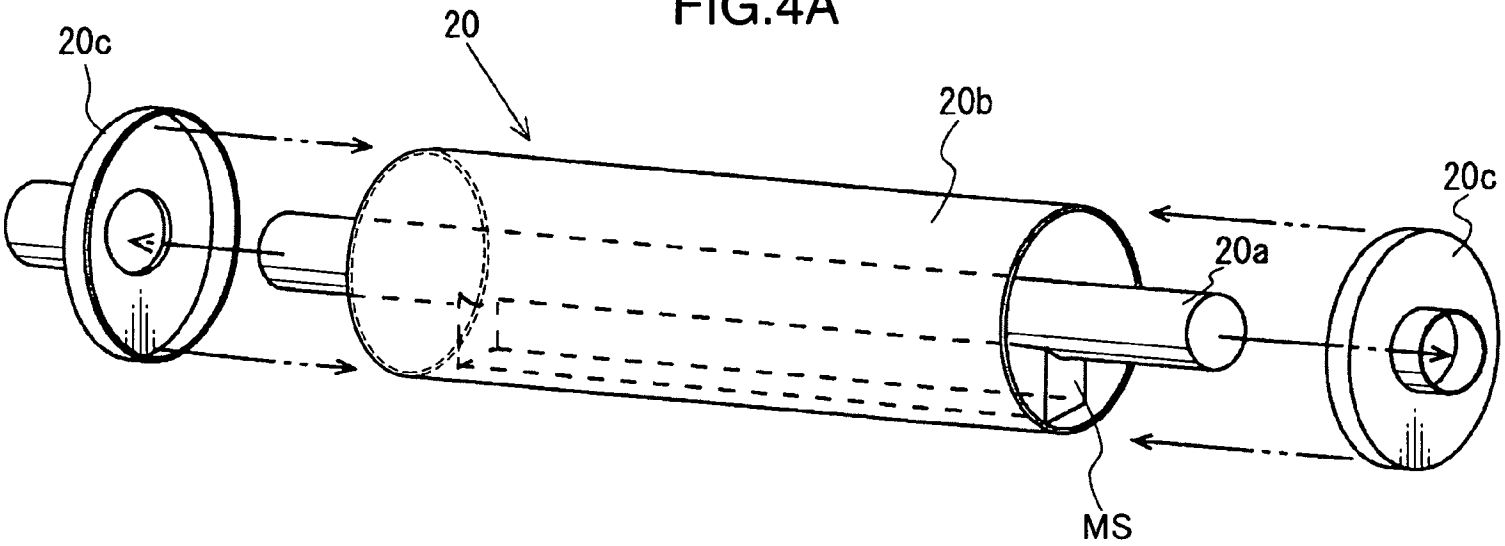
FIGS. 4A and 4B are exploded perspective views showing configurations of a development roller and a magnetic roller shown in FIG. 3.
Figure 4B:
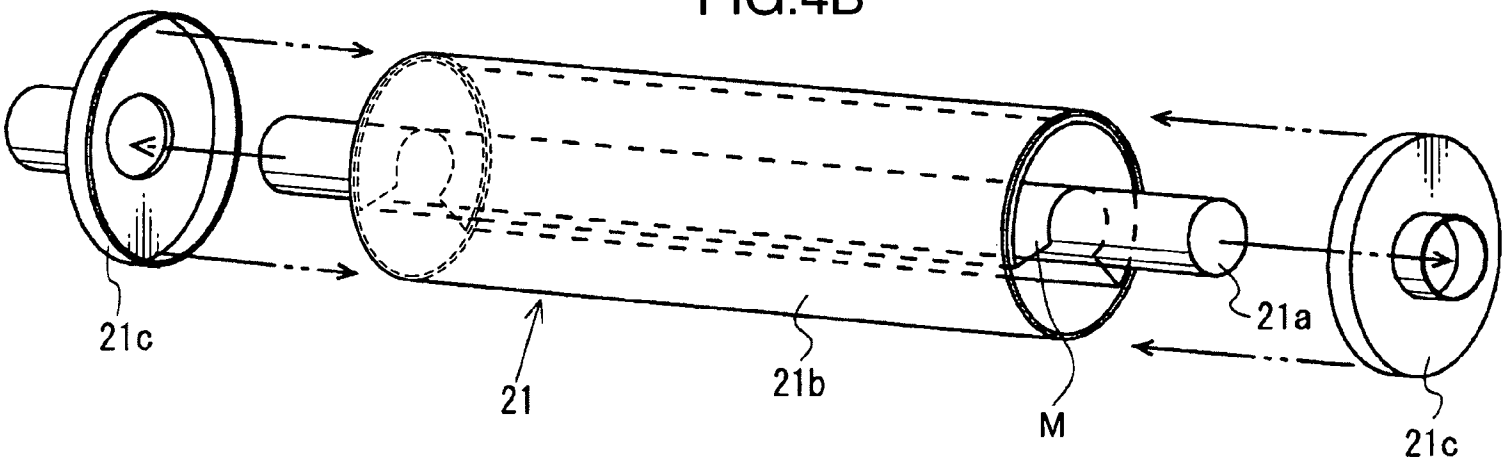

A specific configuration of the development roller 20 and the magnetic roller 21 according to an embodiment of the present invention will be described with respect to FIGS. 4A and 4B. FIGS. 4A and 4B are exploded perspective views showing configurations of the development roller 20 and the magnetic roller 21 shown in FIG. 3. FIG. 4A shows the development roller 20 and FIG. 4B shows the magnetic roller 21. Detailed configurations of magnet members MS and M will be described later. The magnet members MS and M are thus shown in simplified form in FIGS. 4A and 4B.

As shown in FIG. 4A, the development roller 20 includes a roller shaft 20*a*, a sleeve 20*b*, two caps 20*c*, and a magnet member MS elongated along the direction of the shaft line. The magnet member MS is fixed to the roller shaft 20*a* by adhesion or otherwise. The roller shaft 20*a* is passed through the sleeve 20*b*. The circular cap 20*c* is fit in each end of the sleeve 20*b*. Each end of the roller shaft 20*a* protrudes through an opening in the cap 20*c*. A predetermined gap is provided between the magnet member MS and the sleeve 20*b* thus assembled.

When the roller shaft 20*a* of the development roller 20 is supported by the frame 22, the roller shaft 20*a* is non-rotatably supported by supporting means (not shown) and the magnet member MS is also non-rotatably supported at a circumferential predetermined angle. The sleeve 20*b* and the cap 20*c*, on the other hand, are rotatable as a unit and are rotated by a driving means, not shown. The roller shaft 20*a*, the sleeve 20*b*, and the caps 20*c* made of aluminum may be used in the embodiment.

The development roller 20 including these components is provided in such a manner that it faces the photosensitive drum 11*a*. A predetermined gap is provided between the development roller 20 and the photosensitive drum 11*a* (see FIG. 3).

The magnetic roller 21, on the other hand, includes a roller shaft 21*a*, a sleeve 21*b*, two caps 21*c*, and a sector-shaped magnet member M as shown in FIG. 4B.

The roller shaft 21*a* is passed through the sleeve 21*b* and the magnet member M is fixed on the roller shaft 21*a* by adhesion or otherwise. The circular cap 21*c* is fit in each end of the sleeve 21*b*. Each end of the roller shaft 21*a* protrudes through an opening in the cap 21*c*. A predetermined gap is provided between the magnet member M and the sleeve 21*b* thus assembled.

When the roller shaft 21*a* of the magnetic roller 21 is supported by the frame 22, the roller shaft 21*a* is non-rotatably supported by supporting means (not shown) and the magnet member M is non-rotatably supported at a predetermined angle in a circumferential direction. On the other hand, the sleeve 21*b* and the cap 21*c* are rotatable as a unit and rotated by a driving mechanism, not shown. The roller shaft 21*a*, the sleeve 21*b*, and the caps 21*c* made of aluminum may be used in the embodiment.

The magnetic roller 21 including these components is provided above a conveying member 23*a* in such a manner that the magnetic roller 21 faces the development roller 20 with a predetermined gap between them (see FIG. 3). In order to fully supply toner to the development roller 20 and to remove it from the development roller 20, the sleeve 21*b* of the magnetic roller 21 may be formed longer in the shaft line direction than the sleeve 20*b* of the development roller 20.

Figure 5:
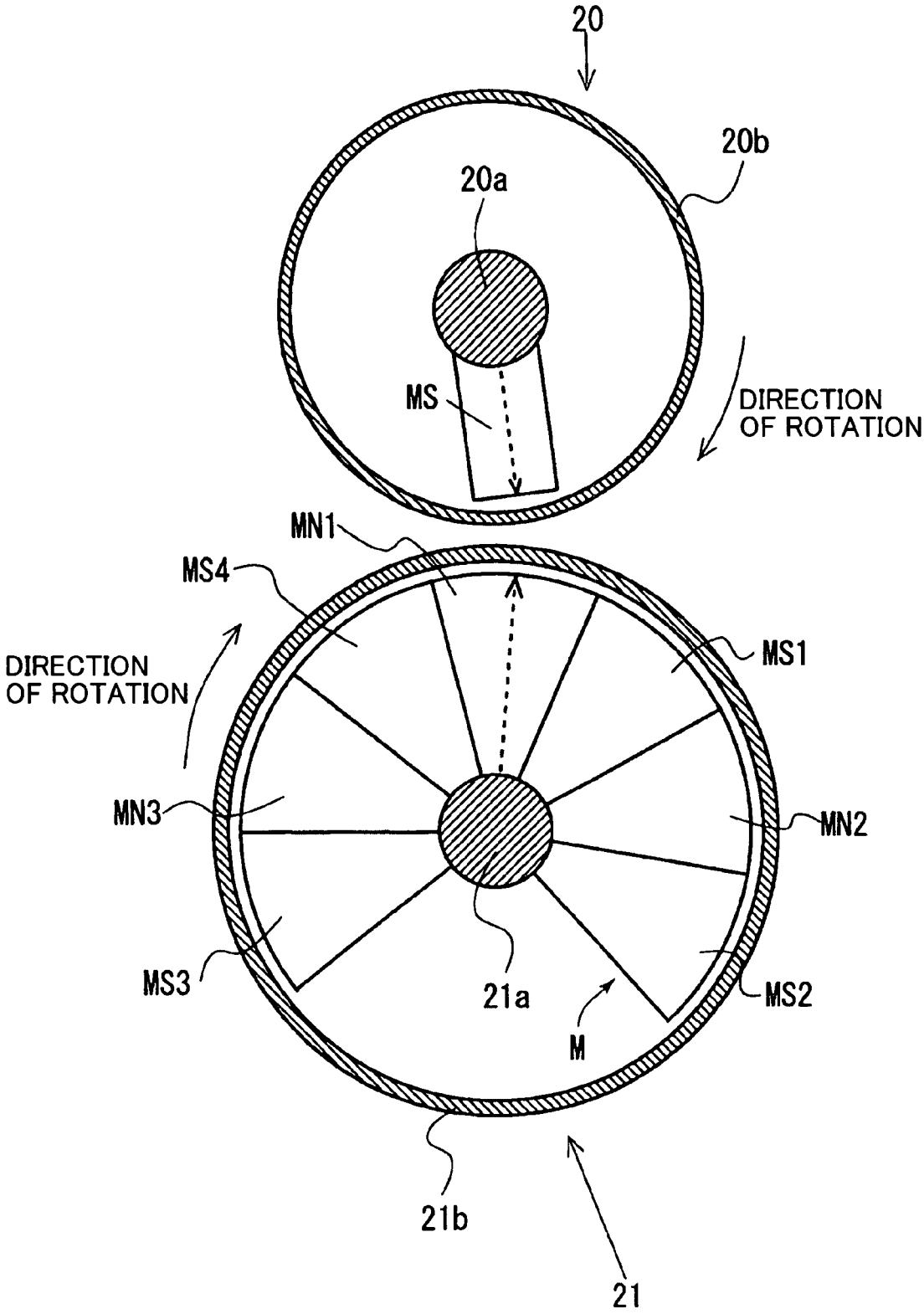
FIG. 5 is a cross-sectional view for illustrating an arrangement of magnet members shown in FIGS. 4A and 4B.

A specific exemplary arrangement of the magnet members MS and M according to an embodiment of the present invention will be described with reference to FIG. 5. FIG. 5 is a cross-sectional view for illustrating the arrangement of the magnet members MS and M shown in FIGS. 4A and 4B. The dashed lines in FIG. 5 represent the directions of the magnetic forces and peak lines of the magnet members MS and MN1. The arrows indicate the directions of rotations of the rollers.

In this embodiment, the magnet member M of the magnetic roller 21 includes magnet members MN1-MN3 and MS1-MS4 and the magnet member MS in the development roller 20 faces the magnet member MN1 in the magnetic roller 21. The magnet members MS and MN1 are arranged so that their polarities at the position where they face each other differ from each other. In particular, the magnet members MS and MN1 are supported in such a manner that the magnet member MS has the south pole and the magnet member MN1 has the north pole at the position where they face each other in the embodiment. Alternatively, the magnet members MS and MN1 may be faced each other so that the magnet member MS has the north pole and the magnet member MN1 has the south pole.

By arranging the magnet members MS and MN1 so that unlike poles face each other at the position where the development roller 20 and the magnetic roller 21 face each other in this way, the lines of magnetic force from the north pole are attracted by the south pole to form a composite magnetic force and therefore a magnet brush is easily created. It should be noted that while a magnetic brush can be created without the magnet member MS in the development roller 20, the magnet members MS and MN1 cannot be disposed in such a manner that same poles face each other (for example the south pole faces the south pole) because a repulsion force is generated.

As shown in FIG. 5, the single magnet member MS provided in the development roller 20 may be a bar magnet having a generally rectangular cross-section, for example, or may be a sector-shaped magnet. The magnet member MS may be any magnet; it may be easy to manufacture the magnet member MS if the magnet member MS is made of a material such as a rubber magnet that can be easily worked.

On the other hand, the magnet member M provided inside the magnetic roller 21 which faces the development roller 20 is made up of seven magnet members MN1-MN3 and MS1-MS4 in the present embodiment. The seven magnet members MN1-MN3 and MS1-MS4 have a generally sector-shaped cross-section in the present embodiment. Alternatively, they may be bar magnets. The magnet members MN1-MN3 and MS1-MS4 may be any magnets; it may be easy to manufacture if they are made of a material such as a rubber magnet that can be easily worked.

The magnet member MN1 is opposed to the magnet member MS. The magnet member MS1 is provided next to the magnet member MN1, magnet member MN2 is provided next to the magnet member MS1, and the magnet member MS2 is provided next to the magnet member MN2, clockwise viewed from the front in FIG. 5.

The magnet member MS3 is spaced a predetermined distance apart from the magnet member MS2, and the magnet member MN3 is provided next to the magnet member MS3 and the magnet member MS4 is provided next to the magnet member MN3. The magnetic pole of each of the magnet members MN1-MN3 and MS1-MS4 nearer to the sleeve 21*b* is as follows. The magnetic poles of the magnet members MN1, MN2, and MN3 are the north pole; the magnetic poles of the magnet members MS1, MS2, MS3, and MS4 are the south pole. The magnet members MN1-MN3 and MS1-MS4 are supported so that they are alternately arranged in general.

The typical surface magnetic flux densities (peak values) of the magnet members MS, MN1-MN3, and MS1-MS4 at the position where they face sleeve 20*b* or 21*b* are as follows: 40 mT for the magnet member MS, 80 to 90 mT for magnet member MN1, 60 mT for magnet member MS1, 60 mT for magnet member MN2, 60 mT for magnet member MS2, 40 mT for magnet member MS3, 40 mT for magnet member MN3, and 60 mT for magnet member MS4. The surface magnetic flux density produced in the gap between the development roller 20 and the magnetic roller 21 at the facing position (the gap between the magnet members MS and MN1) is approximately 110 mT. The surface magnetic flux density of the magnet members MS, MN1-MN3, and MS1-MS4 can be set as appropriate.

The radial length (height) of the magnet members MN1-MN3 and MS1-MS4 of the magnet roller 21 is 3.5 mm. The height of the magnet member MS of the development roller 20 can be smaller than this. The angle of the generally sector-like shape of the magnet members MN1-MN3 and MS1-MS4 of the magnetic roller 21 in the present embodiment is preferably approximately 40 degrees. The angle is 38 degrees in the present embodiment.

The magnet member MS can be disposed in such a manner that the peak of its magnetic force is tilted toward upstream in the direction of circumferential rotation of the sleeve 20*b* from the straight line connecting the center of the roller shaft 20*a* to the center of the roller shaft 21*a*. In other words, the magnet member MS is supported in such a manner that the peak of its magnetic force is positioned upstream in the direction of rotation of the sleeve 20*b* of the development roller 20 at least from the position at which the development roller 20*a* is closest to the magnetic roller 21 on the straight line connecting the center of the roller shaft 20*a* to the center of the roller shaft 21*a*. This ensures that a magnetic brush is tilted toward upstream in the direction of rotation of the sleeve 20*b*. In the present embodiment, the magnet member MS can be supported at an angle of approximately 1 to 10 degrees, for example, preferably approximately 3 to 7 degrees, more preferably approximately 5 degrees, with respect to the straight line connecting the center of the roller shaft 20*a* to the center of the roller shaft 21*a*.

A preferable angle of tilt varies depending on factors such as the shape, type, and magnetic force peak position of the magnet member MS, and the number, arrangement, peak position, and surface magnetic flux density of magnet members M provided in the magnetic roller 21, which will be described later. The angle can be set as appropriate, provided that the magnet member MS is tilted toward upstream in the direction of rotation of the sleeve 20*b* of the development roller 20.

The magnet member MN1 can be supported in such a manner that the peak of its magnetic force is tilted toward downstream in the direction of rotation of the sleeve 21*b* of the magnetic roller 21 from the straight line connecting the center of the roller shaft 20*a* to the center of the roller shaft 21*a*. In other words, the magnet member MN1 is supported in such a manner that the peak of its magnetic force is positioned downstream in the direction of rotation of the sleeve 21*b* of the magnetic roller 21 at least from the position at which the development roller 20 is closest to the magnetic roller 21 on the straight line connecting the center of the roller shaft 20*a* to the center of the roller shaft 21*a*. This ensures that the magnetic brush is tilted toward downstream in the direction of rotation of the sleeve 21*b*. In the present embodiment, the magnet member MN1 can be tilted at an angle of approximately 6 to 22 degrees for example, preferably approximately 10 to 18 degrees, more preferably approximately 14 degrees, with respect to the straight line connecting the center of the roller shaft 20*a* to the center of the roller shaft 21*a*.

A preferable angle of tilt can be set as appropriate as with the magnet member MS because the peak position of the magnetic force of the magnet member MN1 varies depending on factors such as the shape and type of the magnet member MN1 and the magnetic forces and arrangement of the magnet members M. In any case, the magnet member MN1 is tilted toward downstream in the direction of rotation of the sleeve 21*b* of the magnetic roller 21.

Factors such as the shape of the magnetic brush formed as described above and the magnet members MS, MN1-MN3 and MS1-MS4, and the number, arrangement, types, and magnetic forces of provided magnet members MS, MN1-MN3, and MS1-MS4 must be taken into consideration to chose appropriate tilt angles of the magnet members MS and MN1. The angles must be such that the magnet member MS and the magnet member MN1 face each other. For example, if the peak of the magnetic force of the magnet member MS is tilted at an excessive angle, the combined magnetic force of the magnet members MS and MN1 will be too weak to create a good magnetic brush. If the magnet member MN1 is tilted at an excessive angle, the magnet member MS4 adjacent to the magnet member MN1 faces the magnet member MS, and causes a repulsive force, which prevents creation of a magnetic brush. Therefore, the magnet member MS is preferably supported in such a manner that the magnet member MS faces the magnet member MN1 so that the lines of magnetic force from the magnet member MN1 are attracted by the magnet member MS, and the magnet member MS is preferably tilted toward upstream in the direction of rotation of the sleeve 20*b* of the development roller 20 with respect to the straight line connecting the center of the roller shaft 20*a* of the development roller 20 to the center of the roller shaft 21*a* of the magnetic roller 21 within a range in which a magnetic brush is formed.

By supporting the magnet member MN1 or MS or both so that they tilt, the magnetic brush created between the development roller 20 and the magnetic roller 21 is tilted toward downstream in the direction of circumferential rotation of the magnetic roller 21. With this tilt, a developer conveyed from upstream of the direction of circumferential rotation of the magnetic roller 21 is easily introduced in the gap between the development roller 20 and the magnetic roller 21.

Therefore, accumulation of the developer in a region where the toner is supplied to the development roller 20 is prevented and the developer containing carriers are inhibited from being conveyed to the development roller 20, thereby preventing degradation of the quality of an image formed. Depending on the shape or configuration of a developing unit, a developer can spill out of the developing unit and make the interior of the image forming apparatus dirty when the developer accumulates to a large amount. Such spillover can be prevented according to the present embodiment (see FIG. 3). In particular, a developer does not accumulate in a toner supply region A1 where toner is supplied to the development roller 20 and therefore does not spill toward the restraining blade 24 (see FIG. 3). It should be noted that supporting the magnet members MN1 and MS so that they tilt in the opposite direction is undesirable because it can cause accumulation of the developer.

By supporting the magnet member MN1 or MS or both so that they tilt, the lines of magnetic force attracted by the south pole are more concentrated than a case where the magnetic poles are supported straight. As a result, the binding force of the magnetic brush in the region where the toner after development is recovered is increased and therefore the toner can be reliably removed. Thus, toner electrostatically strongly attached onto the development roller 20 can be removed and development history can be prevented. Specifically, the binding force of magnetic brush in a toner recovery area A2 where toner after development is recovered increases and the toner is removed more reliably in the present embodiment, thereby preventing generation of development history (see FIG. 6).

A specific exemplary method for forming a thin layer composed only of toner on the development roller 20 to develop an electrostatic latent image will be described below.

First, the volume resistivity of carriers contained in a developer is chosen to be a value in the range from $10^6$ Ωcm to $10^{13}$ Ωcm. It is desirable that the carriers have a large surface area that contacts the toner because the magnetic brush must remove toner that is electrostatically firmly attached and supply an adequate amount of toner required for development. Carriers having a small diameter of 50 μm or less are used. In this embodiment, coating ferrite carriers having a volume resistivity of $10^{10}$ Ωcm, a saturation magnetization of 65 emu/g, and an average particle diameter of 45 μm are used.

On the other hand, the toner contained in the developer may be, for example, polyester-resin-based toner containing additives such as a charge control substance and silica, and having an average particle diameter of 8 μm. Five percent by weight of toner is contained in the developer. The developer in the embodiment is only illustrative; any well-known developer may be used.

The conveying member 23 first agitates the developer to charge the toner to a predetermined level. A magnetic roller 21 causes the carriers, which are magnetic materials, to hold the toner and causes the carriers to generate a magnetic brush with the magnet members MS, MN1-MN3, and MS1-MS4. The magnetic brush is restrained to a predetermined height by the restraining blade 24 (see FIG. 3).

Different DC voltages from power supplies (not shown) are applied to the development roller 20 and the magnetic roller 21. The potential difference between the voltages applied to the development roller 20 and the magnetic roller 21 produces a thin film composed only of toner on the development roller 20. Since the image forming apparatus 1 in the present embodiment supports color image formation, the level of the voltage applied to the development roller 20 and the magnetic roller 21 varies depending on the charging characteristics of color toner. The greater the potential difference, the thicker thin film of toner on the development roller 20 will be formed and vice versa. In the present embodiment, the potential difference between the rollers is preferably in the range between approximately 100 V and approximately 350 V.

The toner thin film formed and held on the development roller 20 jumps to the photosensitive drum 11*a* in response to an AC voltage applied to the development roller 20. The AC voltage is applied immediately before the development in order to prevent the toner from flying.

Residual toner remaining after the development is removed by the magnetic brush formed between the development roller 20 and the magnetic roller 21 without provision of a special device such as a scraping blade. The developer is replaced by a brushing effect caused by the difference between the circumferential velocities of the rollers and agitation by the conveying member 23 of the developer collected by the magnetic brush.

To facilitate the replacement of the developer, the rotation speed of the sleeve 21*b* of the magnetic roller 21 is set to a value 1.0 to 2.0 times greater than that of the sleeve 20*b* of the development roller 20. A uniform toner layer can be formed by recovering toner on the development roller 20 and supplying the developer whose toner concentration is set to an appropriate value to the development roller 20. In order to maintain a uniform image density, the potential difference between the development roller 20 and the magnetic roller 21 is preferably eliminated except during development, to recover the toner on the development roller 20 onto the magnetic roller 21 without placing a load on the toner.

By forming a thin layer composed only of toner on the outer circumference of the development roller 20 and causing the toner to jump to the photosensitive drum 11*a*, an electrostatic latent image on the photosensitive drum 11*a* is developed. In this case, because the magnetic brush is not brought into direct contact with the photosensitive drum 11*a*, the magnetic brush does not form "brush lines" and therefore the quality of the formed image is improved.

The difference of the present embodiment from a comparative example in formation of a magnetic brush and conveyance of a developer will be described specifically with reference to FIGS. 6 and 7.

Figure 6:
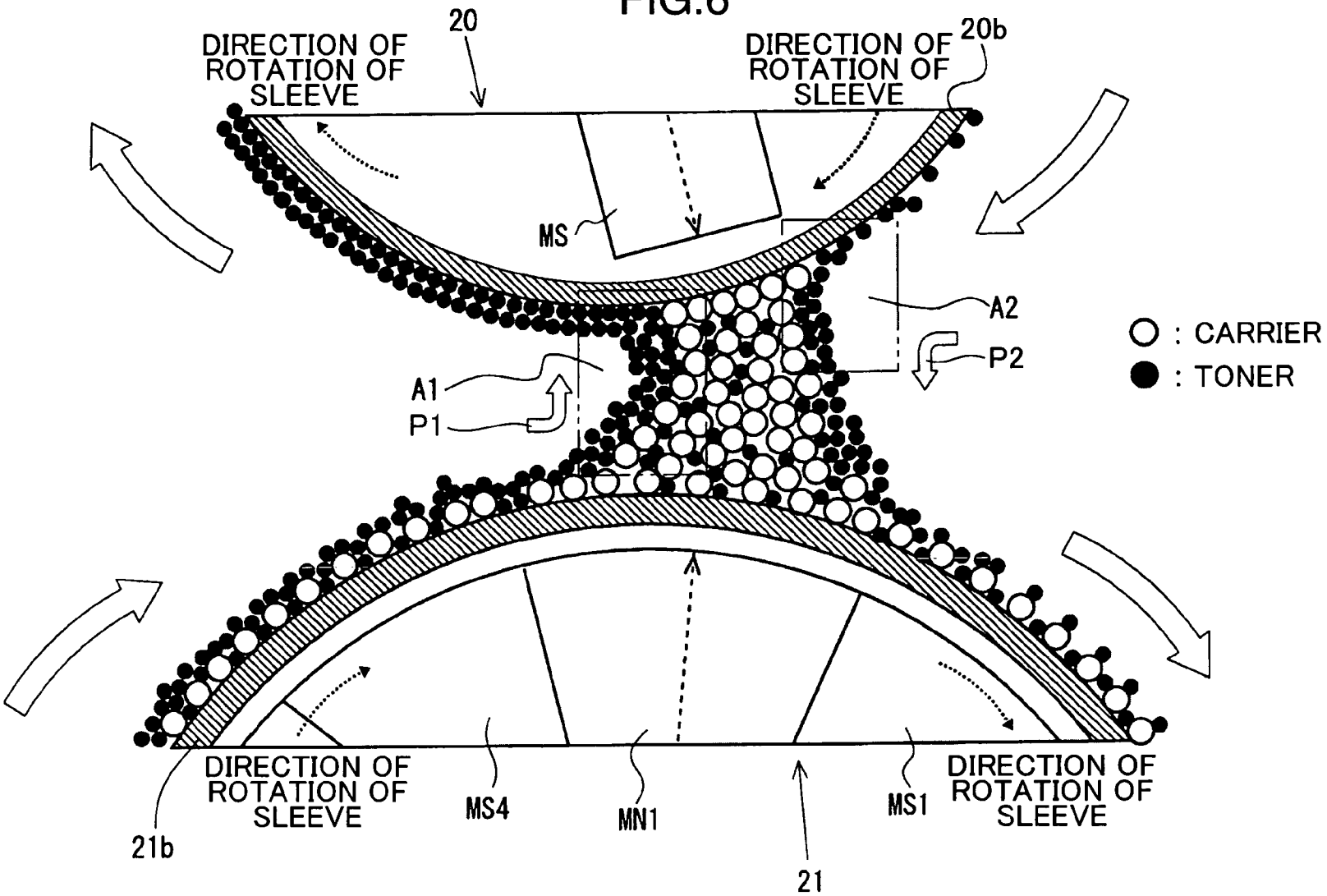
FIG. 6 is a schematic diagram for illustrating formation of a magnetic brush and conveyance of a developer in the developing unit shown in FIG. 2.
Figure 7:
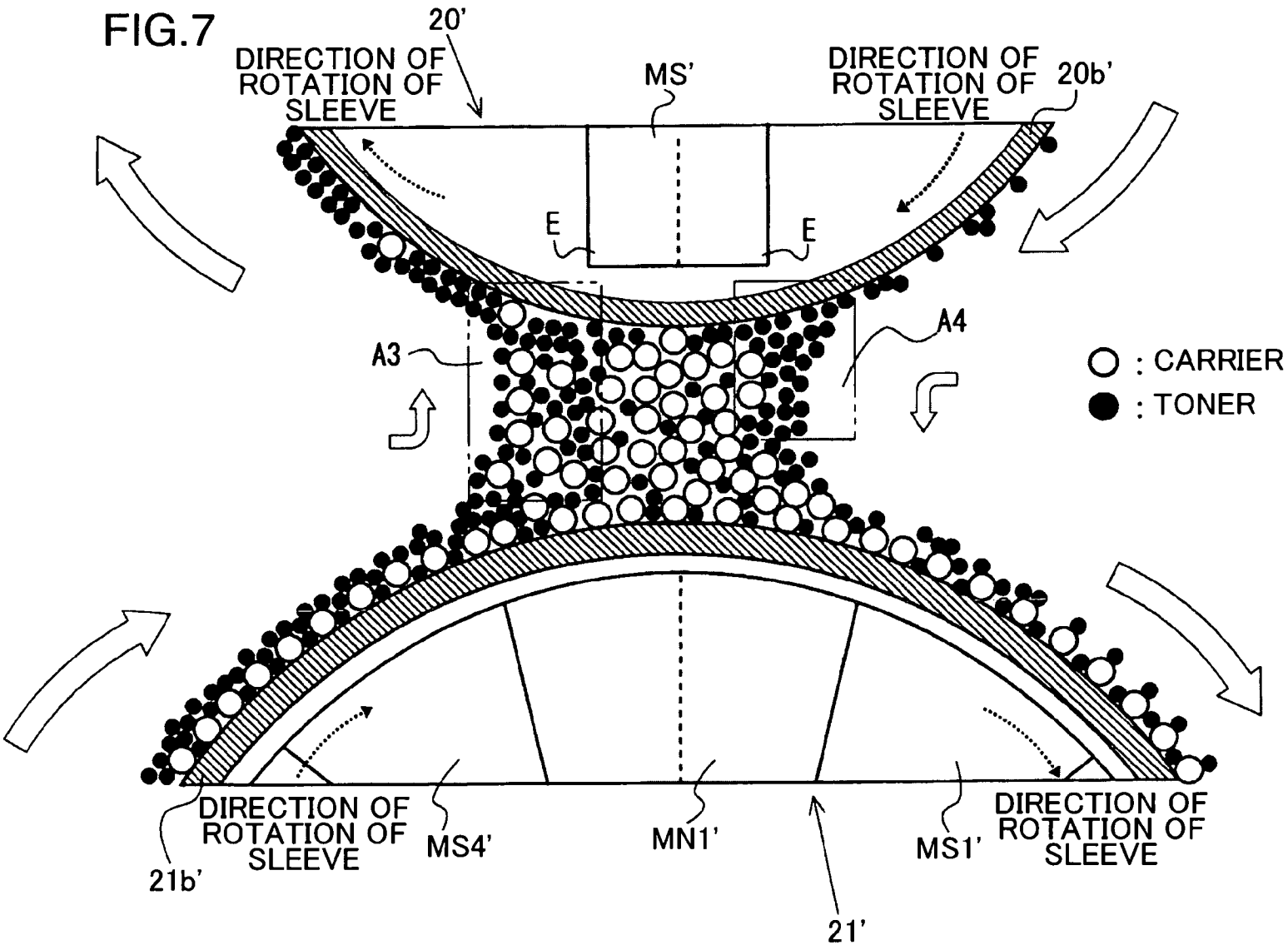
FIG. 7 is a schematic diagram for illustrating formation of a magnetic brush and conveyance of a developer in a comparative example.
Figure 8:
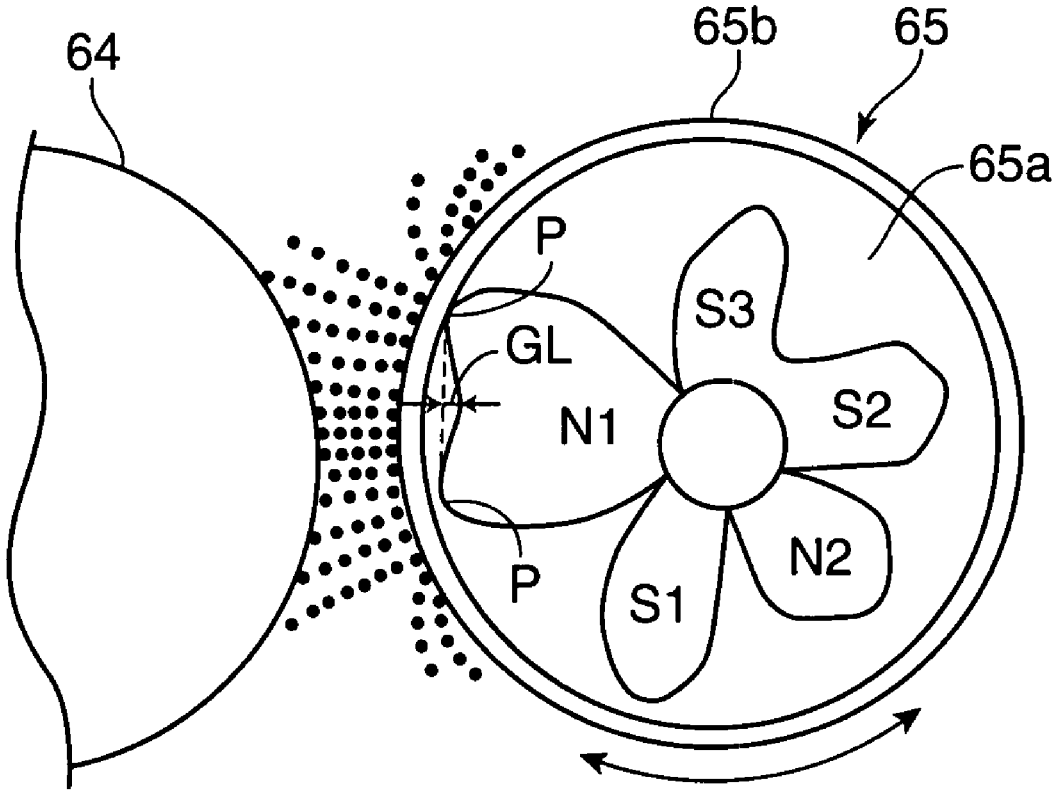
PRIOR ART FIG.8
FIG. 8 is a schematic cross-sectional view for illustrating a conventional developing unit.

FIG. 6 is a schematic diagram for illustrating formation of a magnetic brush and conveyance of a developer according to an embodiment of the present invention and FIG. 7 is a schematic diagram for illustrating formation of a magnetic brush and conveyance of a developer according to the comparative example. The comparative example may be an example described in Japanese Patent Laid-Open No. 06-130819 in which no magnet member is provided in the development roller. However, in order to show the difference more clearly, the comparative example is given in which the peaks of magnetic forces of magnet members MS', MN1'-MN3', and MS1'-MS4' are opposed straight each other on the line connecting the center of the roller shaft 20*a* of the development roller 20 to the center of the roller shaft 21*a* of the magnetic roller 21 in such a manner that unlike magnetic poles face each other. White circles in FIGS. 6 and 7 represent carriers and black circles represent toner particles.

As shown in FIG. 6, the magnet member MS of the development roller 20 and the magnet member MN1 of the magnetic roller 21 are supported so that they face each other. As described earlier, the magnet member MS is supported so that it tilts toward upstream in the direction of rotation of the sleeve 20*b* at a predetermined angle; the magnet member MN1 is supported so that it tilt toward downstream in the direction of rotation of the sleeve 21*b* at a predetermined angle. As indicated by arrows in FIG. 6, the sleeve 20*b* of the development roller 20 and the sleeve 21*b* of the magnetic roller 21 are driven to rotate in the same circumferential direction. That is, the sleeves 20*b* and 21*b* are driven to rotate in the opposite directions at the position where they face each other.

By supporting the magnet members MS and MN1 so that they tilt as shown in FIG. 6, carriers form a magnetic brush that tilts along the direction of rotation of the sleeve 21*b* of the magnetic roller 21. Accordingly, the developer is easily drawn into the gap between the development roller 20 and the magnetic roller 21. Therefore, accumulation of the developer is prevented in the area A1 (indicated by the chain double-dashed box in FIG. 6) where toner is supplied to the development roller 20 and the developer containing carriers is prevented from being conveyed to the development roller 20.

Furthermore, the developer does not accumulate to a large amount and spill over or out of the developing unit 2*a*-2*d*. Therefore the interior of the image forming apparatus 1 is not soiled (see FIG. 3). In particular, the developer does not fall toward the restraining blade 24 in the present embodiment (see FIG. 3). Therefore, the quality of an image formed is not degraded.

In the toner recovery area A2 (indicated by a chain double-dashed box in FIG. 6) where toner conveyed from upstream in the direction of rotation of the development roller 20 is recovered after the development, lines of magnetic force attracted toward the magnet member MS more concentrate than the case where the magnet member MS is supported straight. Consequently, the binding force of the magnetic brush in this area is strong and toner conveyed from upstream in the direction of rotation of the development roller 20 can be reliably removed in the toner recovery area A2 after the development. Thus, toner electrostatically strongly attached to the development roller 20 is removed and therefore development history can be prevented.

Because the magnet members MN1-MN3 and MS1-MS4 of the magnetic roller 21 in the present embodiment are generally sector-shaped and are arranged in such a manner that unlike magnetic poles are alternately arranged, the magnetic force toward the magnet member MS is weakened by the magnet members MS1 and MS4 (whose poles on the sleeve side are the south pole) at both ends of the magnet member MN1 in the circumferential direction. This facilitates formation of a magnetic brush tilted toward downstream in the direction of rotation of the magnetic roller 21 in the toner supply area A1.

Therefore, toner is sequentially conveyed to the surface of the sleeve 21*b* of the magnetic roller 21, the toner supply area A1 and the surface of the sleeve 20*b* of the development roller 20 in the present embodiment as indicated by the white arrows P1 in FIG. 6 and carriers are not mixed. Residual toner remaining on the surface of the sleeve 20*b* after development is removed in the toner recovery area A2 by the magnetic brush as indicated by white arrow P2 in FIG. 6 and is conveyed to the surface of the sleeve 21*b* of the magnetic roller 21. Thus, the toner is conveyed ideally.

On the other hand, if magnet members MS' and MN1' are opposed straight to each other, rather than tilted, as in the comparative example shown in FIG. 7, the magnetic brush formed by carriers is nearly perpendicular to the rotating surface in such a manner that the peaks of the magnetic forces of the magnet members MS' and MN1' are connected. Accordingly, the magnetic brush can act as a wall in the toner supply area A3 (indicated by a chain double-dashed box in FIG. 7). Therefore the developer conveyed on the sleeve 21*b*' is not easily drawn into the gap between the development roller 20' and the magnetic roller 21' and the developer tends to accumulate in the toner supply area A3.

The gap between the development roller 20' and the magnetic roller 21' is where the magnetic roller 21' is closest to the development roller 20', forming the narrowest gap. The conveying ability of the magnetic roller 21', which conveys the developer, is decreased by the developer accumulated upstream in the direction of rotation of the magnetic roller 21' from the portion closest to the development roller 20' (in the direction to the toner supply area A3). Consequently, it becomes more difficult to draw the developer into the gap between the development roller 20' and the magnetic roller 21' and the accumulation of the developer can be accelerated.

As a result, carriers are conveyed together with toner from the toner supply area A3 onto the development roller 20 and the quality of an image formed degrades. When the developer further accumulates in the toner supply area A3, the developer can spill out of the developing unit, making the interior of the image forming apparatus dirty, which can spoil an image formed. In particular, the developer can spill on the restraining blade.

On the other hand, in the toner recovery area A4 (indicated by a chain double-dashed line) in which toner after development is recovered, lines of magnetic force less concentrate at end E of the magnet member MS' and the binding force of the magnetic brush formed is weaker than in the present embodiment. Accordingly, toner electrostatically strongly attached onto the development roller 20' cannot completely be removed. When additional toner is continued to be provided to the toner supply area A3, the thickness of the toner layer increases or a non-uniform amount of charge on toner results to causes development history.

As has been described above with reference to FIGS. 6 and 7, conveyance of the developer and toner is performed more ideally in the embodiment of the present invention than in the comparative example. According to the present embodiment, as has been described, there is provided a developing unit 2*a*-2*d* including: a development roller 20 that is opposed to a photosensitive drum 11*a*-11*d* and supplies toner to the photosensitive drum 11*a*-11*d*, and a magnetic roller 21 that is opposed to the development roller 20 and supplies toner to the development roller 20; wherein sleeves 20*b*, 21*b* of the development roller 20 and the magnetic roller 21 are driven to rotate in the same circumferential direction, a magnet member MS or MN1 is provided in a roller shaft 20*a*, 21*a* in the sleeves 20*b*, 21*b* of the development roller 20 and the magnetic roller 21; their respective magnet members MS, MN1 are opposed to each other in such a manner that their opposite poles face each other, and are supported non-rotatably in the circumferential direction; and the magnet member MS of the development roller 20 is supported so that the peak of the magnetic force of the magnet member MS is positioned upstream in the direction of rotation of the sleeve 20*b* of the development roller 20 from the straight line connecting the center of the roller shaft 20*a* of the development roller 20 to the center of the roller shaft 21*a* of the magnetic roller 21.

Thus, a magnetic brush is formed between the development roller 20 and the magnetic roller 21 and tilts toward downstream in the direction of rotation of the sleeve 21*b* of the magnetic roller 21. Therefore, a developer is easily conveyed toward downstream in the direction of rotation of the magnetic roller 21 and accumulation of the developer can be prevented. Furthermore, the magnet member MS of the development roller 20 is supported at a tilt so that lines of magnetic force concentrate in the pole portion of the magnet member MS and therefore the binding force of the magnetic brush is stronger than in the case where the magnet members MS and MN1 are opposed straight to each other. Therefore toner on the development roller 20 can be more reliably removed.

The magnet member MN1 of the magnetic roller 21 is supported so that the peak of the magnetic force of the magnet member MN1 is positioned downstream in the direction of rotation of the sleeve 21*b* of the magnetic roller 21 from the straight line connecting the center of the roller shaft 20*a* of the development roller 20 to the center of the roller shaft 21*a* of the magnetic roller 21. Thus, the advantageous effect described above is increased.

The surface magnetic flux density of the magnet member MS provided in the development roller 20 is lower than that of the magnet member MN1 provided in the magnetic roller 21 in the position where they face each other. Thus, the magnetic brush can be more easily tilted toward downstream in the direction of rotation of the sleeve 21*b* of the magnetic roller 21 than the case where the surface magnetic flux density of the magnet member MS of the development roller 20 is higher.

By providing the developing unit 2*a*-2*d* in an image forming apparatus 1, development history and accumulation of the developer can be prevented. Carriers are not conveyed on the development roller 20 together with toner and the developer does not spill over or spill out of the developing unit 2*a*-2*d* to soil the interior of the image forming apparatus 1. Thus, an image forming apparatus 1 capable of forming an image of high and stable quality can be provided.

Alternatively, only the magnet member MS of the development roller 20 may be supported at a tilt so that the peak of the magnetic force of the magnet member MS is positioned upstream in the direction of rotation of the sleeve 20*b* of the development roller 20 from the straight line connecting the center of the roller shaft 20*a* of the development roller 20 to the center of the roller shaft 21*a* of the magnetic roller 21, or only the magnet member MN1 of the magnetic roller 21 may be supported at a tilt so that the peak of the magnetic force of the magnet member MN1 is positioned downstream in the direction of rotation of the sleeve 21*b* of the magnetic roller 21 from the straight line connecting the center of the roller shaft 20*a* of the development roller 20 to the center of the roller shaft 20*a* of the magnetic roller 21. In either case, the same advantageous effect can be obtained.

While the present invention has been described with respect to embodiments of the present invention, the scope of the present invention is not limited to these. Various modifications can be made and implemented without departing from the sprit of the present invention.

For example, while seven magnet members M are provided in the magnetic roller 21 in the embodiment described above, the present invention is not so limited. While the angle of the sector-like shape is chosen to be 38 degrees in the embodiment described above, the angle is not limited to this. When the angle of the sector-like shape is chosen to be a greater value, fewer magnet members M may be provided. When the angle of the sector-like shape is increased, the angle between the magnet members MS and MN1 of tilt toward downstream in the direction of rotation of the sleeve 21*b* of the magnetic roller 21 varies. The tilt angle may be set appropriately by taking into consideration the diameters of the development roller 20 and the magnetic roller 21, and the arrangement and the peak of magnetic force of the magnet members MS, MN1-MN3 and MS1-MS4, so that a magnetic brush is formed properly.

The length of the magnet members MS, MN1-MN3, and MS1-MS4 in the direction of radius of the roller is not limited to the specific value given in the embodiment. If the length is chosen to be a different value, a different angle of tilt of the magnet member MS toward upstream in the direction of rotation of the sleeve 20*b* and a different angle of the magnet member MN1 toward downstream in the direction of rotation of the sleeve 21*b* are to be chosen. The angles may be set appropriately so that a magnetic bush is formed properly.

As has been described, a developing unit according to one aspect of the present invention includes: a development roller that is opposed to an image carrier and supplies toner to the image carrier; and a magnetic roller that is opposed to the development roller and supplies toner to the development roller, wherein a sleeve of the development roller and a sleeve of the magnetic roller are driven to rotate in the same circumferential direction; a first magnet member is provided on a roller shaft in the sleeve of the development roller; a second magnet member is provided on a roller shaft in the sleeve of the magnetic roller; the first and second magnet members are opposed to each other in such a manner that opposite poles face each other, and are supported non-rotatably in the circumferential directions; and the first magnet member is supported so that the peak of the magnetic force of the first magnet member is positioned upstream in the direction of rotation of the sleeve of the development roller from the straight line connecting the center of the roller shaft of the development roller to the center of the roller shaft of the magnetic roller.

With the configuration described above, since the first magnet member of the development roller is supported in such a manner that the peak of the magnetic force of the first magnet member is positioned upstream in the direction of rotation of the sleeve of the development roller from the straight line connecting the center of the roller shaft of the development roller to the center of the roller shaft of the magnetic roller, a magnetic brush is formed between the development roller and the magnetic roller that tilt toward downstream in the direction of rotation of the sleeve of the magnetic roller. Therefore, a developer is easily conveyed toward downstream in the direction of rotation of the magnetic roller and accumulation of the developer can be prevented. Furthermore, by supporting the first magnet member of the development roller as described above, lines of magnetic force concentrate in a magnetic pole portion of the development roller. Therefore, the binding force of the magnetic brush is stronger and toner on the development roller is more reliably removed than the case where the first magnet member is opposed straight to the second magnet member.

The surface magnetic flux density of the first magnet member is preferably lower than that of the second magnet member in the position where they are opposed to each other.

In that case, since the surface magnetic flux density of the first magnet member provided in the development roller is lower than that of the second magnet member provided in the magnetic roller in the position where both magnet members face each other, the magnetic brush that tilts toward downstream in the direction of rotation of the sleeve of the magnetic roller can be more easily formed than the case where the surface magnetic flux density of the first magnet member of the development roller is higher.

The first magnet member is preferably supported at a predetermined tilt angle toward upstream in the direction of rotation of the sleeve of the development roller with respect to the straight line connecting the center of the roller shaft of the development roller to the center of the roller shaft of the magnetic roller.

In that case, a magnetic brush that tilts toward downstream in the direction of rotation of the sleeve of the magnetic roller can be easily formed between the development roller and the magnetic roller. Therefore, accumulation of a developer can be prevented and, in addition, the binding force of the magnetic brush can be increased to reliably remove toner on the development roller.

The first magnet member is preferably opposed to the second magnet member in such a manner that lines of magnetic force from the second magnet member are attracted to the first magnet member and the first magnet member is preferably supported at a tilt angle toward upstream in the direction of rotation of the sleeve of the development roller with respect to the straight line connecting the center of the roller shaft of the development roller to the center of the roller shaft of the magnetic roller in a range in which a magnetic brush is formed.

In that case, a magnetic brush that tilts toward downstream in the direction of rotation of the sleeve of the magnetic roller can be stably formed between the development roller and the magnetic roller.

The second magnet member is preferably supported in such a manner that the peak of the magnetic force of the second magnet member is positioned downstream in the direction of rotation of the sleeve of the magnetic roller from the straight line connecting the center of the roller shaft of the development roller to the center of roller shaft of the magnetic roller.

In that case, the second magnet member of the magnetic roller is supported so that the peak of the magnetic force is positioned downstream in the direction of rotation of the sleeve of the magnetic roller from the straight line connecting the center of the roller shaft of the development roller to the center of the roller shaft of the magnetic roller. This effect of the second magnet member, in combination with the effect of the first magnet member, ensures that the magnetic brush that tilts toward downstream in the direction of rotation of the sleeve of the magnetic roller is reliably formed between the development roller and the magnetic roller. Therefore, the developer is more easily conveyed toward downstream in the direction of rotation of the magnetic roller and accumulation of the developer can be more effectively prevented. In addition, by supporting the second magnet member of the magnetic roller as described above, lines of magnetic force more concentrate in the magnetic pole portion of the development roller. Therefore, the binding force of the magnetic brush is stronger, toner on the development roller is more reliably removed, and a larger advantageous effect can be obtained than the case where the second magnet member is opposed straight to the first magnet member.

The second magnet member is preferably supported at a predetermined tilt angle toward downstream in the direction of rotation of the sleeve of the magnetic roller with respect to the straight line connecting the center of the roller shaft of the development roller to the center of the roller shaft of the magnetic roller.

In that case, since the magnetic brush that tilts toward downstream in the direction of rotation of the sleeve of the magnetic roller can be easily formed between the development roller and the magnetic roller, accumulation of a developer can be prevented and the binding force of the magnetic brush is increased to reliably remove toner on the development roller.

Preferably, the second magnet member is provided between third and fourth magnet members that have the polarity opposite to that of the second magnet member and the cross-section of the second to fourth magnet members has a generally sector-like shape.

In that case, since the third and fourth magnet members reduce the magnetic force toward the first magnet member, a magnet brush that tilts toward downstream in the direction of rotation of the magnetic roller can be easily formed in a toner supply area.

The magnetic roller preferably uses a two-component developer composed of carriers and toner to supply toner to the development roller.

In that case, since a magnetic brush composed of carriers is formed at a tilt along the direction of rotation of the sleeve of the magnetic roller, the developer is easily drawn into the gap between the development roller and the magnetic roller. Therefore, the developer does not accumulate in the area from which toner is supplied to the development roller and the developer containing carriers is not conveyed to the development roller.

A developing unit according to another aspect of the present invention includes: a development roller that is opposed to an image carrier and supplies toner to the image carrier; and a magnetic roller that is opposed to the development roller and supplies toner to the development roller, wherein a sleeve of the development roller and a sleeve of the magnetic roller are driven to rotate in the same circumferential direction; a first magnet member is provided on a roller shaft in the sleeve of the development roller; a second magnet member is provided on a roller shaft in the sleeve of the magnetic roller; the first and second magnet members are opposed to each other in such a manner that opposite poles face each other; and are supported non-rotatably in the circumferential directions and the second magnet member is supported so that the peak of the magnetic force of the second magnet member is positioned downstream in the direction of rotation of the sleeve of the magnetic roller from the straight line connecting the center of the roller shaft of the development roller to the center of the roller shaft of the magnetic roller.

With the configuration described above, since the second magnet member of the magnetic roller is supported in such a manner that the peak of the magnetic force of the second magnet member is positioned downstream in the direction of rotation of the sleeve of the magnetic roller from the straight line connecting the center of the roller shaft of the development roller to the center of the roller shaft of the magnetic roller, a magnetic brush is formed between the development roller and the magnetic roller that tilt toward downstream in the direction of rotation of the sleeve of the magnetic roller. Therefore, a developer is easily conveyed toward downstream in the direction of rotation of the magnetic roller and accumulation of the developer can be prevented. Furthermore, by supporting the second magnet member of the magnetic roller as described above, lines of magnetic force concentrate in a magnetic pole portion of the development roller. Therefore, the binding force of the magnetic brush is stronger and toner on the development roller is more reliably removed than the case where the second magnet member is opposed straight to the first magnet member.

An image forming apparatus according to yet another aspect of the present invention includes the developing unit described above and an image carrier supplied with toner from the developing unit.

With this configuration, development history and accumulation of a developer are prevented and therefore carriers are not conveyed on the development roller together with toner and the developer does not spill over or out of the developing unit to soil the interior of the image forming apparatus. Thus, an image forming apparatus capable of forming a high-quality and stable image can be provided.

This application is based on patent application No. 2006-171780 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing unit comprising:

a development roller that is opposed to an image carrier and supplies toner to the image carrier; and a magnetic roller that is opposed to the development roller and supplies toner to the development roller;

wherein a sleeve of the development roller and a sleeve of the magnetic roller are driven to rotate in the same circumferential direction;

a first magnet member is provided on a roller shaft in the sleeve of the development roller;

a second magnet member is provided on a roller shaft in the sleeve of the magnetic roller;

the first and second magnet members are opposed to each other so that opposite polarities face each other, and are supported non-rotatably in circumferential directions;

the first magnet member is supported so that the peak of magnetic force of the first magnet member is positioned upstream in the direction of rotation of the sleeve of the development roller from the straight line connecting the center of the roller shaft of the development roller to the center of the roller shaft of the magnetic roller;

the second magnet member is provided between third and fourth magnet members having a polarity opposite to the polarity of the second magnet member;

a cross-section of the second to fourth magnet members has a generally sector-like shape; and the first magnet member is a bar magnet having a generally rectangular cross-section, wherein the first magnet member has a height measured parallel to a radius of the development roller that is smaller than a radial length of the second to fourth magnet members, and the first magnet member has a width measured perpendicular to the height that is smaller than the length of the arc of the second to fourth magnet members.

2. The developing unit according to claim 1, wherein the surface magnetic flux density of the first magnet member is smaller than that of the second magnet member in a position where the first and second magnet members are opposed to each other.

3. The developing unit according to claim 1, wherein the first magnet member is supported at a predetermined tilt angle toward upstream in the direction of rotation of the sleeve of the development roller with respect to the straight line connecting the center of the roller shaft of the development roller to the center of the roller shaft of the magnetic roller.

4. The developing unit according to claim 3, wherein the first magnet member is opposed to the second magnet member in such a manner that lines of magnetic force from the second magnet member are attracted to the first magnet member, and the first magnet member is supported at a tilt toward upstream in the direction of rotation of the sleeve of the development roller with respect to the straight line connecting the center of the roller shaft of the development roller to the center of the roller shaft of the magnetic roller within a range in which a magnetic brush is formed.

5. The developing unit according to claim 1, wherein the second magnet member is supported in such a manner that the peak of magnetic force of the second magnet member is positioned downstream in the direction of rotation of the sleeve of the magnetic roller from the straight line connecting the center of the roller shaft of the development roller to the center of the roller shaft of the magnetic roller.

6. The developing unit according to claim 5, wherein the second magnet member is supported at a predetermined tilt angle toward downstream in the direction of rotation of the sleeve of the magnetic roller with respect to the straight line connecting the center of the roller shaft of the development roller to the center of the roller shaft of the magnetic roller.

7. The developing unit according to claim 1, wherein the magnetic roller uses a two-component developer including carriers and toner to supply toner to the development roller.

8. An image forming apparatus comprising:

the developing unit according to claim 1; and an image carrier supplied with toner from the developing unit.

9. A developing unit comprising:

a development roller that is opposed to an image carrier and supplies toner to the image carrier; and a magnetic roller that is opposed to the development roller and supplies toner to the development roller;

wherein a sleeve of the development roller and a sleeve of the magnetic roller are driven to rotate in the same circumferential direction;

a first magnet member is provided on a roller shaft in the sleeve of the development roller;

a second magnet member is provided on a roller shaft in the sleeve of the magnetic roller;

the first and second magnet members are opposed to each other so that opposite polarities face each other, and are supported non-rotatably in circumferential directions;

the second magnet member is supported so that the peak of magnetic force of the first magnet member is positioned downstream in the direction of rotation of the sleeve of the magnetic roller from the straight line connecting the center of the roller shaft of the development roller to the center of the roller shaft of the magnetic roller;

the second magnet member is provided between third and fourth magnet members having a polarity opposite to the polarity of the second magnet member;

a cross-section of the second to fourth magnet members has a generally sector-like shape; and the first magnet member is a bar magnet having a generally rectangular cross-section, wherein the first magnet member has a height measured parallel to a radius of the development roller that is smaller than a radial length of the second to fourth magnet members, and the first magnet member has a width measured perpendicular to the height that is smaller than the length of the arc of the second to fourth magnet members.

* * * * *